US007561939B2

(12) United States Patent
Kawabe et al.

(10) Patent No.: US 7,561,939 B2
(45) Date of Patent: Jul. 14, 2009

(54) DATA PROCESSING DEVICE

(75) Inventors: Noriko Kawabe, Nagoya (JP); Haruna Kato, Tsushima (JP); Motoshi Kishi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 560 days.

(21) Appl. No.: 11/313,621

(22) Filed: Dec. 22, 2005

(65) Prior Publication Data

US 2006/0137582 A1 Jun. 29, 2006

(30) Foreign Application Priority Data

Dec. 28, 2004 (JP) ..... 2004-379524

(51) Int. Cl.
*D05C 5/02* (2006.01)

(52) U.S. Cl. ..... 700/138; 112/475.18

(58) Field of Classification Search ..... 700/130–133, 700/136–138; 112/102.5, 475.01, 475.04, 112/475.05, 475.18; 101/481, 483, 485, 101/486

See application file for complete search history.

(56) References Cited

U.S. PATENT DOCUMENTS 5,144,899 A * 9/1992 Allen ..... 112/470.05
6,435,117 B2 * 8/2002 Codos et al. ..... 112/470.05
2007/0022930 A1 * 2/2007 Hagino et al. ..... 112/102.5

FOREIGN PATENT DOCUMENTS

JP A 11-076662 3/1999

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

There is provided a data processing device, which includes a data providing unit that provides print data and embroidery data to be subjected to printing and embroidering, respectively. A print region of the print data and an embroidery region of the embroidery data have a predetermined positional relationship. The data processing device further includes a data correction unit that corrects at least one of the embroidery data and the print data so that the predetermined positional relationship between the embroidery region defined in the embroidery data and the print region defined in the print data is maintained on fabric after the embroidering in accordance with the embroidery data and the printing in accordance with the print data are performed on the fabric, considering shrinkage of the fabric caused by the embroidering in accordance with the embroidery data.

66 Claims, 13 Drawing Sheets

| CORRECTION CONDITION | EMBROIDERY CONDITION | CORRECTION VALUE (mm) |
|---|---|---|
| FABRIC TYPE | KNIT | 0.1 |
| THREAD TYPE | NYLON | 0.1 |
| TYPE OF EMBROIDERY FRAME | LARGE | 0.1 |
| THREAD DENSITY | DENSITY≥4.5LINES/mm | 0.1 |
| AREA OF EMBROIDERY REGION | AREA≥5000mm² | 0.1 |

FIG. 4

| STITCH FROM | CORRECTION RATIO |
|---|---|
| SATIN STITCH | CORRECTION RATIO a (3%) |
| TATAMI STITCH | CORRECTION RATIO b (1%) |

FIG. 5

<<EMBROIDERY CONDITION SETTING MENU>>

EXECUTION OF CORRECTION : YES NO
FABRIC TYPE : KNIT OTHERS
THREAD TYPE : NYLON OTHERS
TYPE OF EMBROIDERY FRAME : LARGE MEDIUM SMALL
TARGET OF CORRECTION : PRINT DATA EMBROIDERY DATA
POSITIONAL RELATIONSHIP : OVERLAP SURROUNDING PARALLEL

14

<<EMBROIDERY CONDITION SETTING MENU>>

EXECUTION OF CORRECTION : YES NO
FABRIC TYPE : KNIT OTHERS
THREAD TYPE : NYLON OTHERS
TYPE OF EMBROIDERY FRAME : LARGE MEDIUM SMALL
TARGET OF CORRECTION : PRINT DATA EMBROIDERY DATA
POSITIONAL RELATIONSHIP : OVERLAP SURROUNDING PARALLEL

14

<<EMBROIDERY CONDITION SETTING MENU>>

EXECUTION OF CORRECTION : YES NO
FABRIC TYPE : KNIT OTHERS
THREAD TYPE : NYLON OTHERS
TYPE OF EMBROIDERY FRAME : LARGE MEDIUM SMALL
TARGET OF CORRECTION : PRINT DATA EMBROIDERY DATA
POSITIONAL RELATIONSHIP : OVERLAP SURROUNDING PARALLEL

DATA PROCESSING DEVICE

CROSS-REFERENCE TO RELATED APPLICATION

This application claims priority under 35 U.S.C. §119 from Japanese Patent Application No. 2004-379524, filed on Dec. 28, 2004. The entire subject matter of the application is incorporated herein by reference.

BACKGROUND

1. Technical Field

Aspects of the present disclosure relate to a device configured to process print data and embroidery data for printing and embroidering.

2. Description of Related Art

An embroidering device, having a function of generating a bitmap image of an embroidery pattern from embroidery data (i.e., so-called stitch data containing a plurality of needle drop points) and printing out the bitmap image on fabric in addition to a function of embroidering patterns on fabric, has been proposed. An example of such an embroidering device is disclosed in Japanese Patent Provisional Publication No. HEI 11-76662 (hereafter, refereed to as JP-11-76662A).

As a technique for generating image data from embroidery data, JP-11-76662A discloses that a contour line is obtained for each of embroidery regions contained in embroidery data, and image data of the whole area defined by the contour line is generated for each embroidery region. In the embroidery data, a color designation code representing a thread color is contained at the top portion of each embroidery region. Therefore, by associating a color designation code with corresponding image data, it is possible to display and print out images of the embroidery regions in colors respectively corresponding to the color designation codes of the embroidery regions.

In general, fabric shrinks when an embroidery pattern is embroidered on the fabric by a sewing machine, and the degree of shrinkage of fabric increases as contractibility of the fabric increases. If print data and embroidery data are generated from image data of an image containing a plurality of patterns in accordance with the above mentioned technique disclosed in JP-11-76662A, and an image of the print data is printed on fabric and an embroidery pattern of the embroidery data is embroidered on the fabric, the printed image of the print data may be displaced from the embroidered pattern of the embroidery data because the technique of JP-11-76662A dose not consider a phenomenon of shrinkage of fabric due to embroidering.

SUMMARY

Aspects of the present disclosure are advantageous in that a device, capable of processing print data and embroidery data so that a positional relationship between a printed image of the print data and an embroidered pattern of the embroidery data on fabric is not lost by shrinkage of fabric due to embroidering in accordance with the embroidery data, is provided.

BRIEF DESCRIPTION OF THE ACCOMPANYING DRAWINGS

FIG. 1 schematically shows a configuration of an embroidering and printing system.

FIG. 4 shows a correction value table used to secure consistency in sizes of an embroidery region and a printed image region.

FIG. 5 shows a correction ratio table.

DETAILED DESCRIPTION

General Overview

Figure 1:
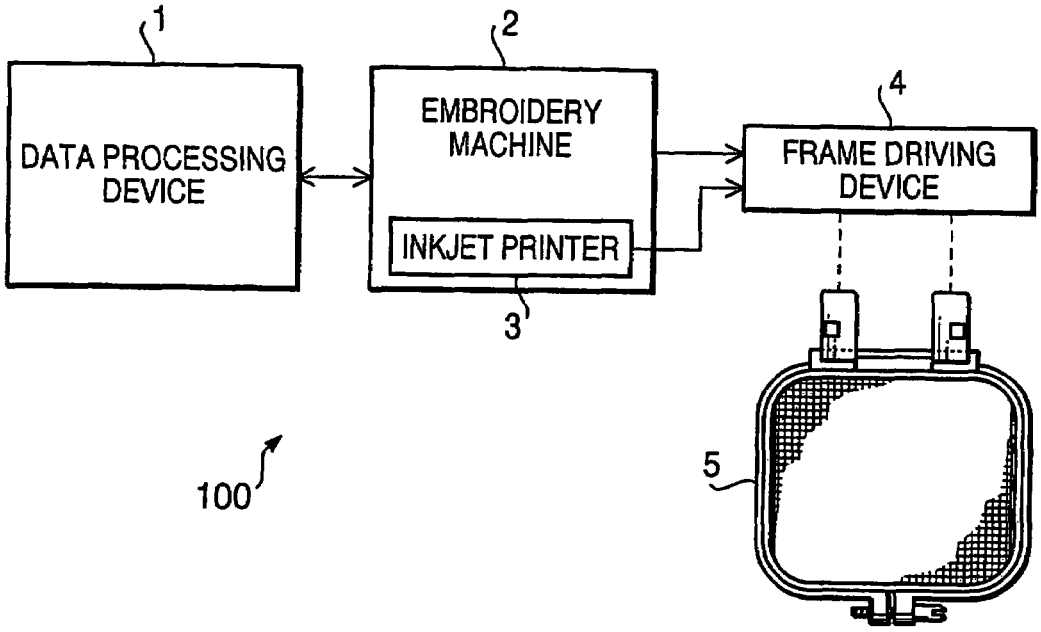

According to an aspect of the disclosure, there is provided a data processing device, which includes a data providing unit that provides print data and embroidery data to be subjected to printing and embroidering, respectively. A print region of the print data and an embroidery region of the embroidery data have a predetermined positional relationship. The data processing device further includes a data correction unit that corrects at least one of the embroidery data and the print data so that the predetermined positional relationship between the embroidery region defined in the embroidery data and the print region defined in the print data is maintained on fabric after the embroidering in accordance with the embroidery data and the printing in accordance with the print data are performed on the fabric, considering shrinkage of the fabric caused by the embroidering in accordance with the embroidery data.

With the configuration, it becomes possible to prevent displacement of printed image of the print data with respect to an embroidered pattern of the embroidery data from occurring on fabric.

In an example, the predetermined positional relationship between the embroidery region and the print region may be such that the embroidery region overlaps with the print region. In this case, the data correction unit may correct at least one of the embroidery data and the print data so that an outer shape of the embroidery region and an outer shape of the print region are kept from shifting with respect to each other on the fabric even if shrinkage of the fabric is caused by the embroidering in accordance with the embroidery data.

In another example, the predetermined positional relationship between the embroidery region and the print region may be such that the embroidery region is surrounded by the print region. In this case, the data correction unit may correct at least one of the embroidery data and the print data so that an outer shape of the embroidery region and an inner shape of the print region are kept from shifting with respect to each other on the fabric even if shrinkage of the fabric is caused by the embroidering in accordance with the embroidery data.

Optionally, the data providing unit may be configured to obtain the embroidery data from an external device and to generate the print data based on the obtained embroidery data.

Still optionally, the data providing unit may be configured to obtain image data from an external device and to generate the embroidery data and the print data based on the obtained data.

Optionally, the data correction unit may correct at least one of the embroidery data and the print data according to a predetermined condition.

Still optionally, the data correction unit may correct the print data so as to shrink a size of the print region in a predetermined direction.

Still optionally, the data correction unit may be configured to determine a direction of stitches of an embroidery pattern defined in the embroidery data, and to correct the print data so as to shrink the size of the print region in the determined direction of stitches.

Still optionally, the data correction unit may be configured to determine a form of stitches of an embroidery pattern defined in the embroidery data, and to correct the print data if the determined form of stitches corresponds to a predetermined stitch form.

Still optionally, the data correction unit may be configured to determine a thread density of an embroidery pattern defined in the embroidery data, and to correct the print data according to the determined thread density.

Still optionally, the data correction unit may be configured to determine an area of the embroidery region based on the embroidery data, and to correct the print data according to the determined area of the embroidery region.

Still optionally, the data processing device may include a setting unit that allows an operator to designate a fabric type. In this case, the data correction unit may correct the print data according to the fabric type designated by the operator through the setting unit.

Still optionally, the data processing device may include a setting unit that allows an operator to designate a thread type. In this case, the data correction unit may correct the print data according to the thread type designated by the operator through the setting unit.

Still optionally, the data processing device may include a setting unit that allows an operator to designate a type of an embroidery frame used for holding fabric in the embroidering. In this case, the data correction unit may correct the print data according to the type of the embroidery frame designated by the operator through the setting unit.

In a particular case, the data correction unit may correct the embroidery data so as to enlarge a size of the embroidery region in a predetermined direction.

Optionally, the data correction unit may be configured to determine a direction of stitches of an embroidery pattern defined in the embroidery data, and to correct the embroidery data so as to enlarge the size of the embroidery region in the determined direction of stitches.

Still optionally, the data correction unit may be configured to determine a form of stitches of an embroidery pattern defined in the embroidery data, and to correct the embroidery data if the determined form of stitches corresponds to a predetermined stitch form.

Still optionally, the data correction unit may be configured to determine a thread density of an embroidery pattern defined in the embroidery data, and to correct the embroidery data according to the determined thread density.

Still optionally, the data correction unit may be configured to determine an area of the embroidery region based on the embroidery data, and to correct the embroidery data according to the determined area of the embroidery region.

Still optionally, the data processing device may include a setting unit that allows an operator to designate a fabric type. In this case, the data correction unit may correct the embroidery data according to the fabric type designated by the operator through the setting unit.

Still optionally, the data processing device may include a setting unit that allows an operator to designate a thread type. In this case, the data correction unit may correct the embroidery data according to the thread type designated by the operator through the setting unit.

Still optionally, the data processing device may include a setting unit that allows an operator to designate a type of an embroidery frame used for holding fabric in the embroidering. In this case, the data correction unit may correct the embroidery data according to the type of the embroidery frame designated by the operator through the setting unit.

According to another aspect of the disclosure, there is provided a data processing device, which includes a data providing unit that provides embroidery data to be subjected to an embroidering operation, a contracting region obtaining unit that obtains a contracting region generated as a difference between a shape of the embroidery region defined in the embroidery data and a shape of the embroidery region formed on fabric when shrinkage of the fabric is caused by the embroidering operation in accordance with the embroidery data, and a print data generation unit that generates print data used for a printing operation for the contracting region.

With the configuration, it becomes possible to prevent displacement of printed image of the print data with respect to an embroidered pattern of the embroidery data from occurring on fabric.

Optionally, the contracting region obtaining unit may obtain the contracting region by calculation based on a predetermined condition.

Still optionally, the data providing unit may be configured to obtain image data from an external device and to generate the embroidery data based on the obtained image data.

According to another aspect of the disclosure, there is provided a computer program product for use on a computer, the computer program product comprising a computer program that causes the computer, when executed, to perform a method of processing data for embroidering. The method includes providing print data and embroidery data to be subjected to printing and embroidering, respectively. A print region of the print data and an embroidery region of the embroidery data have a predetermined positional relationship. The method further includes correcting at least one of the embroidery data and the print data so that the predetermined positional relationship between the embroidery region and the print region is maintained on fabric after the embroidering in accordance with the embroidery data and the printing in accordance with the print data are performed on the fabric, considering shrinkage of the fabric caused by the embroidering in accordance with the embroidery data.

With the configuration, it becomes possible to prevent displacement of printed image of the print data with respect to an embroidered pattern of the embroidery data from occurring on fabric.

In an example, the predetermined positional relationship between the embroidery region and the print region may be such that the embroidery region overlaps with the print region. In this case, in the correcting step, at least one of the embroidery data and the print data may be corrected so that an outer shape of the embroidery region and an outer shape of the print region are kept from shifting with respect to each other on the fabric even if shrinkage of the fabric is caused by the embroidering in accordance with the embroidery data.

In another example, the predetermined positional relationship between the embroidery region and the print region may be such that the embroidery region is surrounded by the print region. In this case, in the correcting step, at least one of the embroidery data and the print data may be corrected so that an outer shape of the embroidery region and an inner shape of the print region are kept from shifting with respect to each other on the fabric even if shrinkage of the fabric is caused by the embroidering in accordance with the embroidery data.

Optionally, the providing step may include obtaining the embroidery data from an external device, and generating the print data based on the obtained embroidery data.

Still optionally, the providing step may include obtaining image data from an external device, and generating the embroidery data and the print data based on the obtained image data.

Still optionally, in the correcting step, at least one of the embroidery data and the print data may be corrected according to a predetermined condition.

Still optionally, in the correcting step, the print data may be corrected so as to shrink a size of the print region in a predetermined direction.

Still optionally, the correcting step may include determining a direction of stitches of an embroidery pattern defined in the embroidery data, and correcting the print data so as to shrink the size of the print region in the determined direction of stitches.

Still optionally, the correcting step may include determining a form of stitches of an embroidery pattern defined in the embroidery data, and correcting the print data if the determined form of stitches corresponds to a predetermined stitch form.

Still optionally, the correcting step may include determining a thread density of an embroidery pattern defined in the embroidery data, and correcting the print data according to the determined thread density.

Still optionally, the correcting step may include determining an area of the embroidery region based on the embroidery data, and correcting the print data according to the determined area of the embroidery region.

Still optionally, the method may include the step of allowing an operator to designate a fabric type. In the case, in the correcting step, the print data may be corrected according to the fabric type designated by the operator.

Still optionally, the method may include the step of allowing an operator to designate a thread type. In this case, in the correcting step, the print data may be corrected according to the thread type designated by the operator.

Still optionally, the method may include the step of allowing an operator to designate a type of an embroidery frame used for holding fabric in the embroidering. In this case, in the correcting step, the print data may be corrected according to the type of the embroidery frame designated by the operator.

In a particular case, in the correcting step, the embroidery data may be corrected so as to enlarge a size of the embroidery region in a predetermined direction.

Optionally, the correcting step may include determining a direction of stitches of an embroidery pattern defined in the embroidery data, and correcting the embroidery data so as to enlarge the size of the embroidery region in the determined direction of stitches.

Still optionally, the correcting step may include determining a form of stitches of an embroidery pattern defined in the embroidery data, and correcting the embroidery data if the determined form of stitches corresponds to a predetermined stitch form.

Still optionally, the correcting step may include determining a thread density of an embroidery pattern defined in the embroidery data, and correcting the embroidery data according to the determined thread density.

Still optionally, the correcting step may include determining an area of the embroidery region based on the embroidery data, and correcting the embroidery data according to the determined area of the embroidery region.

Still optionally, the method may include the step of allowing an operator to designate a fabric type. In this case, in the correcting step, the embroidery data may be corrected according to the fabric type designated by the operator.

Still optionally, the method may include the step of allowing an operator to designate a thread type. In this case, in the correcting step, the embroidery data may be corrected according to the thread type designated by the operator.

Still optionally, the method may include the step of allowing an operator to designate a type of an embroidery frame used for holding fabric in the embroidering. In this case, in the correcting step, the embroidery data may be corrected according to the type of the embroidery frame designated by the operator.

According to another aspect of the disclosure, there is provided a computer program product for use on a computer, the computer program product comprising a computer program that causes the computer, when executed, to perform a method of processing data for embroidering. The method includes the steps of providing embroidery data to be subjected to an embroidering operation, obtaining a contracting region generated as a difference between a shape of an embroidery region defined in the embroidery data and a shape of the embroidery region formed on fabric when shrinkage of the fabric is caused by the embroidering operation in accordance with the embroidery data, and generating print data used for a printing operation for the contracting region.

With the configuration, it becomes possible to prevent displacement of printed image of the print data with respect to an embroidered pattern of the embroidery data from occurring on fabric.

Optionally, in the obtaining step, the contracting region may be obtained by calculation based on a predetermined condition.

Still optionally, the providing step may include obtaining image data from an external device, and generating the embroidery data based on the obtained image data.

Aspects of the disclosure may be implemented in computer software as programs storable on computer-readable media including but not limited to RAMs, ROMs, flash memory, EEPROMs, CD-media, DVD-media, temporary storage, hard disk drives, floppy disks, permanent storage, and the like.

ILLUSTRATIVE EMBODIMENTS

Hereafter, an illustrative embodiment according to the disclosure will be described with reference to the accompanying drawings.

FIG. 1 schematically shows a configuration of an embroidering and printing system 100 including a data processing device 1, an embroidery machine 2 and a frame driving device 4. In the system 100, the data processing device 1 is connected to the embroidery machine 2 having an inkjet printer 3, and the frame driving device 4 is connected to the embroidery machine 2. One of various types of embroidery frames 5 can be detachably attached to the frame driving device 4.

The frame driving device 4 is configured to move the embroidery frame 5, in two directions intersecting at right angles, for an embroidery operation to be executed by the embroidery machine 2 and a printing operation to be executed by the inkjet printer 3.

Figure 2:
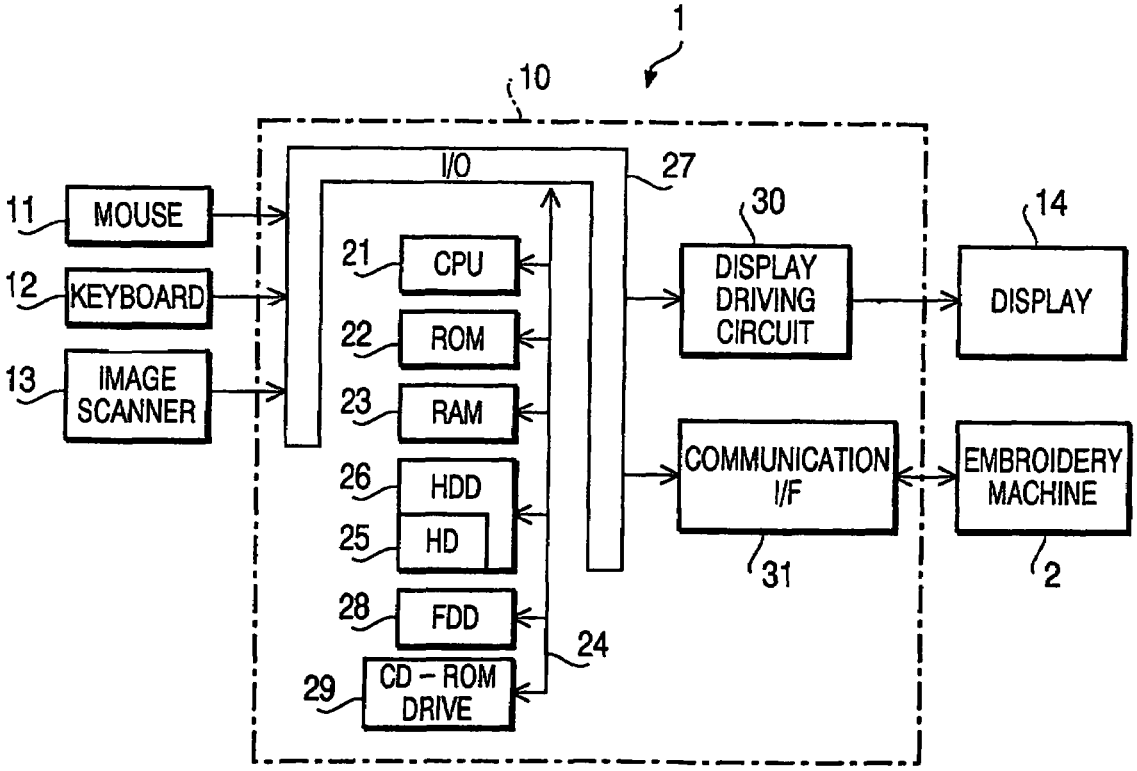
FIG. 2 is a block diagram of a data processing device provided in the embroidering and printing system.

FIG. 2 is a block diagram of the data processing device 1 which is constituted by a personal computer. As shown in FIG. 2, the data processing device 1 includes a control unit 10, a mouse 11 connected to the control unit 10, a keyboard 12, an image scanner 13 and a display 14. The control unit 10 includes a microcomputer having a CPU (central processing unit) 21, a ROM 22, and a RAM 23, which are connected to each other via a bus 24. The controller 10 further includes a hard disk drive (HDD) 26 having a hard disk (HD) 25 and an input/output (I/O) interface 27.

A flexible disk drive (FDD) 28 and a CD-ROM drive 29 are also connected to the bus 24. The mouse 11, the keyboard 12, the image scanner 13, a display driving circuit 30 for driving the display 14, and a communication interface 31 interfacing the control unit 10 with the embroidery machine 2 are connected to the I/O interface 27.

In the ROM 22, various types of programs, such as a start up program for starting up the personal computer (the data processing device 1), are stored. In the RAM 23, an image data memory area for storing image data of printing patterns read by the image scanner 13 or read from a flexible disk or a CD-ROM, an embroidery data memory area for storing embroidery data of embroidery patterns, areas for storing results of calculating operations of the CPU 21, buffer areas, pointer areas, counter areas, and the like are allocated, and these areas are used on an as needed basis.

In the hard disk 25, an operating system, drivers for the mouse 11, keyboard 12, the image scanner 13 and the display 14, application programs and the like are stored. A control program for obtaining image data or embroidery data from the image scanner 13, the flexible disk, or the CD-ROM, a data input/output control program for storing the image data or the embroidery data in the image data memory area or the embroidery data memory area, a control program for embroidery data processing are also stored in the HDD 26 (see FIG. 5). Print data or embroidery data may be stored in the HDD 26.

Figure 3:
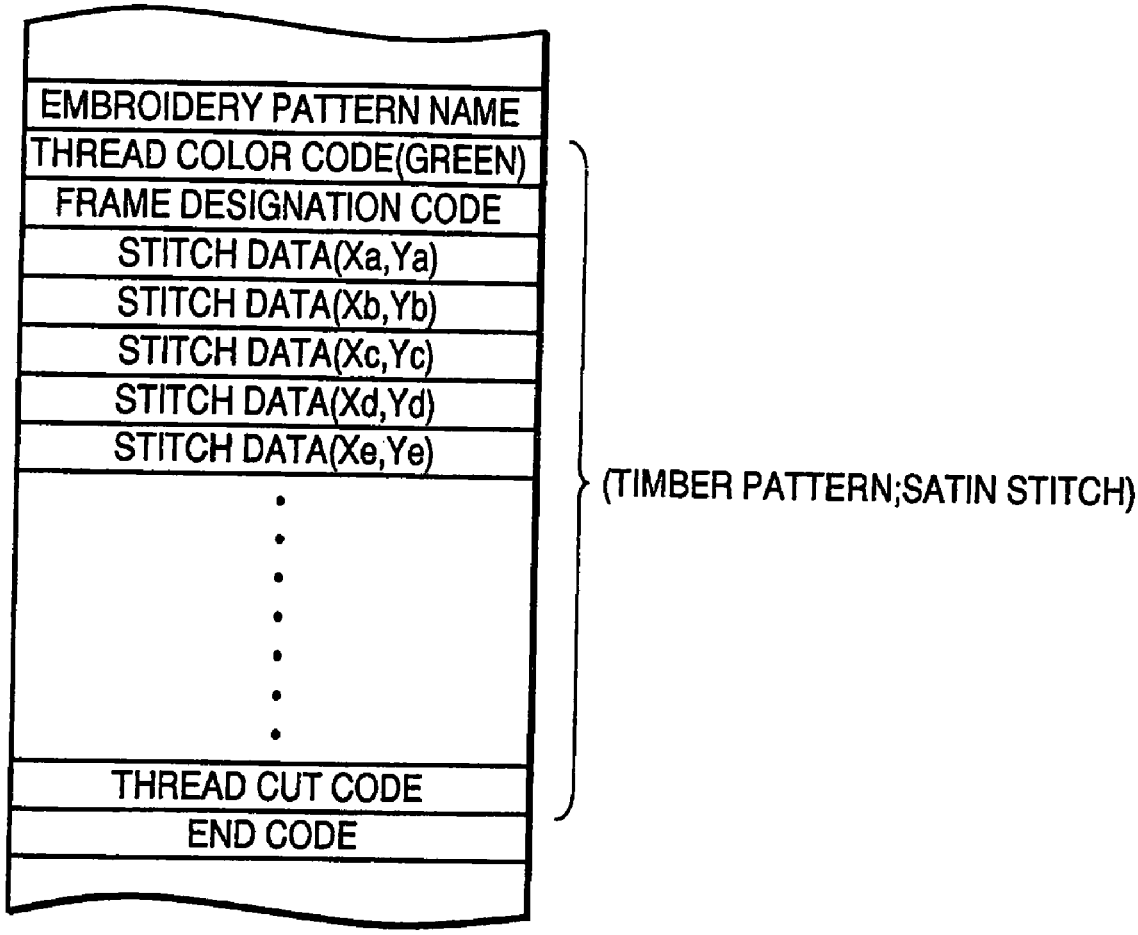
FIG. 3 shows an example of embroidery data for forming an embroidery pattern of a design of a timber in a green color with satin stitch.
Figure 11:
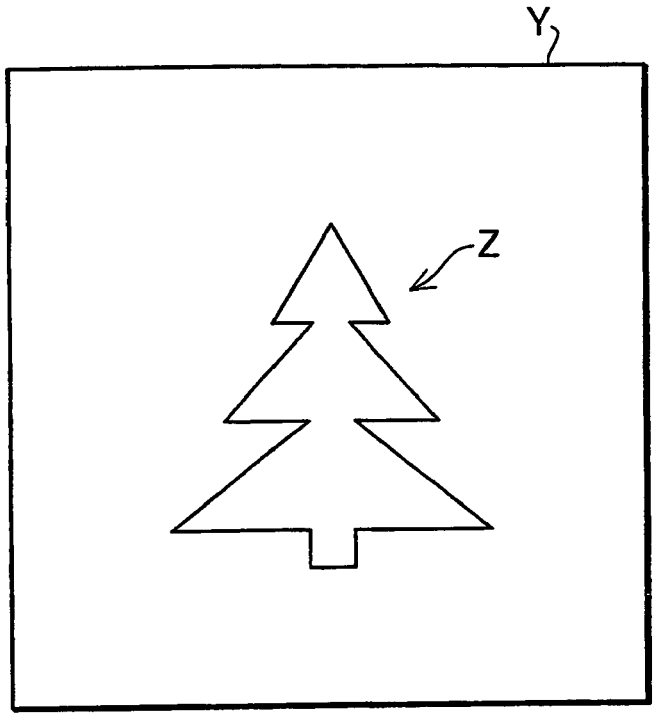
FIG. 11 shows a design of a timber drawn on a sheet.

FIG. 3 shows an example of embroidery data for forming an embroidery pattern (a design of a timber Z shown in FIG. 11) in a green color with satin stitch. As shown in FIG. 3, the embroidery data includes an embroidery pattern name, a thread color code indicating a thread color to be used for embroidering, a frame designation code indicating the type of the embroidery frame 5 to be used, and pieces of stitch data representing positions of needle drop points (i.e., the pieces of stitch data are relative coordinates representing moving amounts of the embroidery frame from a needle drop point to a next needle drop point), and a thread cut code for instructing the embroidery machine 2 to perform thread cut. The type of the embroidery frame 5, on which fabric is to be held in a stretched state, is determined according to the size of an embroidery pattern to be formed.

Meanwhile, if an embroidery pattern is embroidered on knit fabric, or thread made of nylon is used for embroidering, shrinkage of fabric tends to occur in an area in which the embroidery pattern is formed in comparison with a case where an embroidery pattern is formed on fabric of a different type (e.g., textile fabric) or a case where thread of a different type (e.g., thread made of polyester) is used for embroidering. If such shrinkage of fabric occurs, inconsistency in sizes of an embroidery region and a printed image region may occur.

In order to avoid such inconsistency in sizes of an embroidery region and a printed image region, one of sizes of embroidery data (embroidery region) and print data (print image region) is corrected to secure consistency in sizes of an embroidery region and a printed image region as described in detail below. FIG. 4 shows a correction value table T1 used to secure consistency in sizes of an embroidery region and a printed image region. The correction value table T1 may be stored in the HD 25.

In the correction value table Ti, a correction criterion, a stitch condition, and a correction value are related to each other. As shown in FIG. 4, a fabric type and a thread type are defined as items of the correction criterion since, as described above, the shrinkage of fabric occurs depending on the fabric type and the thread type. In addition to the fabric type and the thread type, a frame type is contained in the correction value table T1 as an item of a correction criterion considering the fact that possibility of occurrence of the shrinkage of fabric increases as the size of the embroidery frame 5 increases. Because possibility of occurrence of the shrinkage of fabric increases as a thread density or a size of an embroidery region increases, the thread density and the size of an embroidery region are defined as items of the correction criterion.

In this embodiment, a correction ratio table T2 shown in FIG. 5 is used to secure consistency in sizes of an embroidery region and a printed image region, together with the correction value table T1. As shown in FIG. 5, a stitch form and a correction ratio are related to each other in the correction ratio table T2. The correction ratio is determined considering the fact that possibility of occurrence of shrinkage of fabric is high in satin stitch or tatami stitch relative to the case of running stitch.

Figure 6:
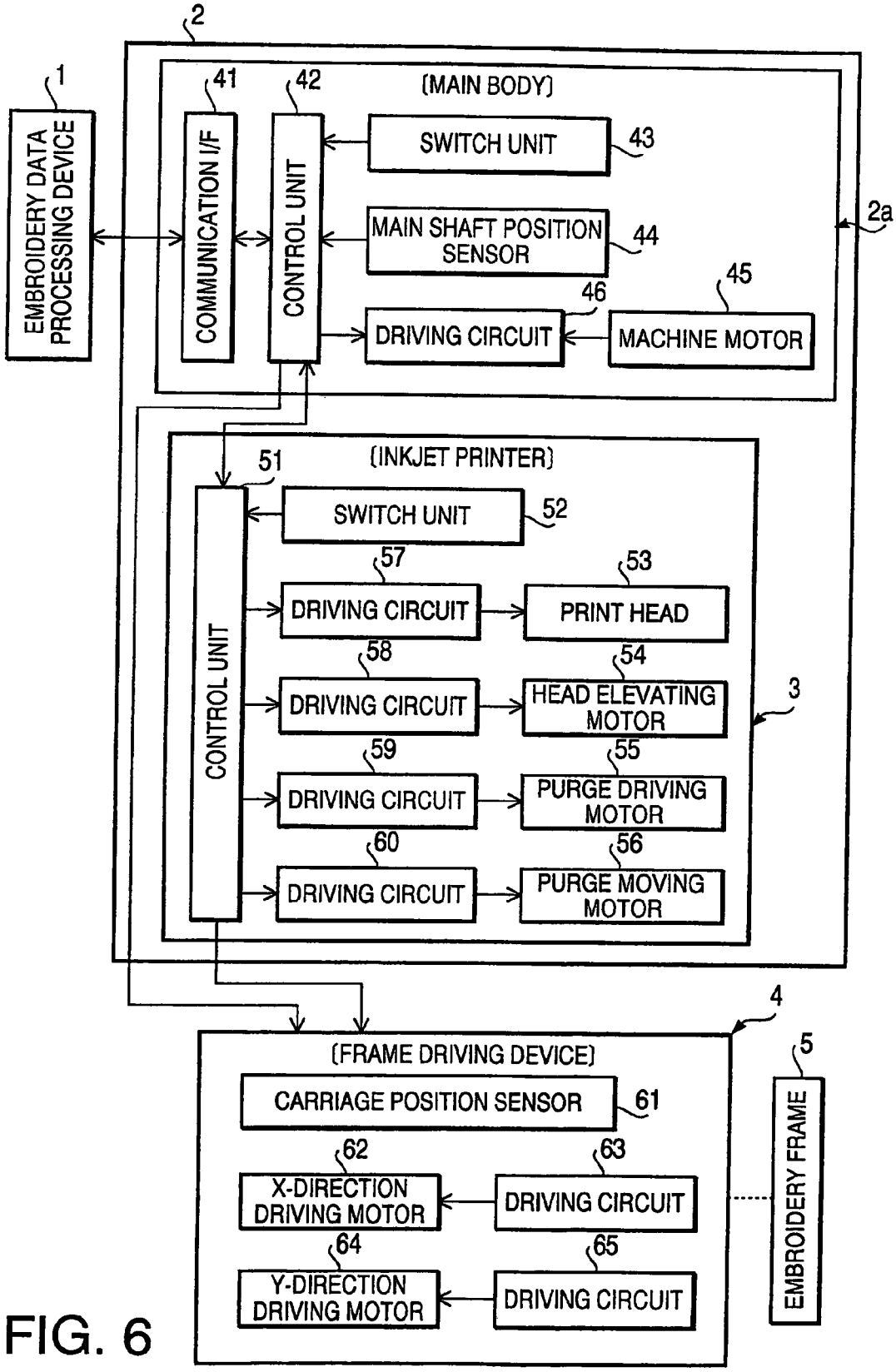
FIG. 6 is a block diagram of an embroidery machine provided in the embroidering and printing system.

As shown in FIG. 6, the embroidery machine 2 includes a main body 2*a*. The main body 2*a* includes a communication interface (I/F) 41, a control unit 42, a switch unit 43 having various types of switches, a main shaft position sensor 44, a machine motor 45 and a driving circuit 46 for the machine motor 45. The control unit 42 is connected to the data processing device 1 via the communication I/F 41. By rotations of the machine motor 45, a main shaft (not shown) is rotated. The rotations of the main shaft cause a needle bar up-and-down driving mechanism (not shown) to move a needle bar up and down. By cooperation of the up and down movement of a sewing needle of the needle bar and a thread taker mechanism (not shown) provided in a bed portion, embroidery stitches are formed on fabric W held by the embroidery frame 5.

The inkjet printer 3 includes a control unit 51, a switch unit 52 having various types of switches, a print head 53 in which nozzles for four colors (cyan, magenta, yellow and black) are arranged in four rows, a head elevating motor 54, a purge driving motor 55, a purge moving motor 56, driving circuits 57, 58, 59 and 60 provided for the print head 53, the head elevating motor 54, the purge driving motor 55 and the purge moving motor 56, respectively. When the print head 53 receives a print command from the control unit 51, the print head 53 operates to eject ink downwardly to the fabric W through use of deformation of a piezoelectric ceramic actuator.

The frame driving device 4 includes a carriage position sensor 61, an x-direction driving motor 62 for moving the embroidery frame 5 in an x-direction, a y-direction driving motor 64 for moving the embroidery frame 5 in a y-direction, driving circuits 63 and 65 provided for the x-direction driving motor 62 and the y-direction driving motor 64, respectively. When the frame driving device 4 receives a frame movement command signal from the control unit 42 of the main body 2*a* of the embroidery machine 2 or the control unit 51 of the inkjet printer 3, the frame driving device 4 drives the x-direction motor 62 and the y-direction motor 64 to move the embroidery frame 5 in the x and y directions.

Hereafter, data processing routines executed under control of the control unit 10 of the data processing device 1 will be explained with reference to FIGS. 7 to 10. In the following, "Si" (i=11, 12, 13, . . . ) represents the number of each step. In the following, explanations of data processing will be given, assuming that embroidery data and print data have already been obtained and stored in the data processing device 1 by reading a design Z of a timber shown in FIG. 11 through the image scanner 13.

Figure 7:
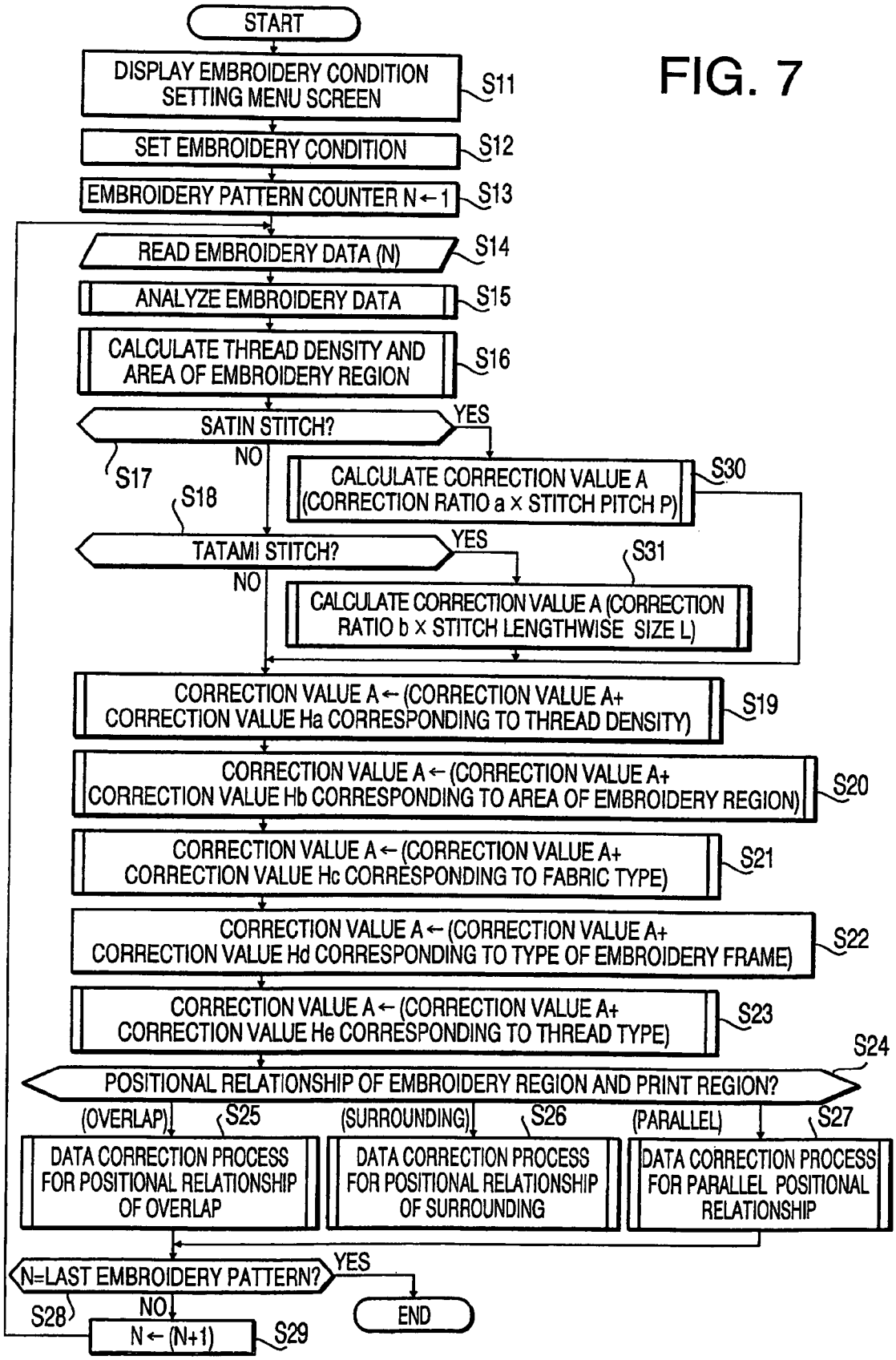
FIG. 7 is a flowchart illustrating a data processing main routine.
Figures 13, 14:
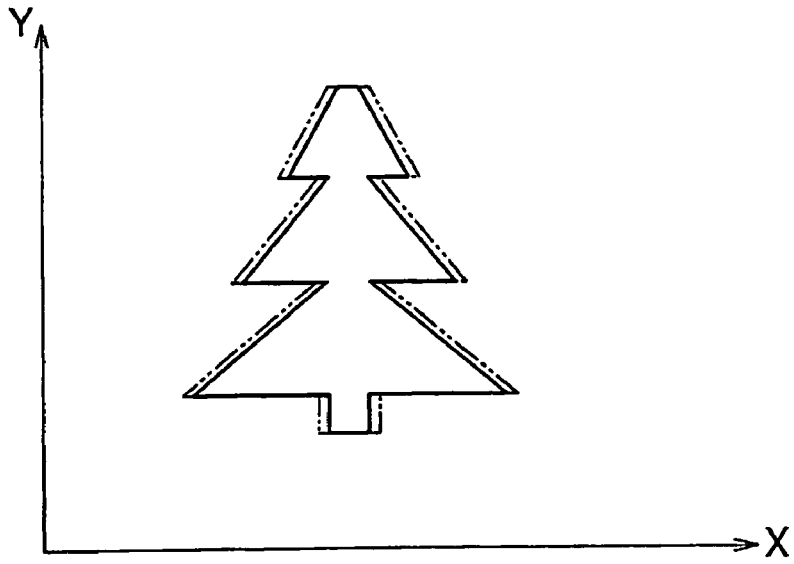
FIG. 13 shows an example of an embroidery condition displayed on a setting menu screen.
FIG. 14 illustrates a situation in which an embroidery region of embroidery data is enlarged.

If an item of data processing is selected by an operator through a main menu displayed on the display 14, a data processing main routine shown in FIG. 7 is initiated. First, an embroidery condition setting menu screen is displayed on the display 14 as shown in FIG. 13 (S11). Through the embroidery condition setting screen, an operator is allowed to designate a correction target (embroidery data or print data) to be targeted for correction of data, in addition to stitch conditions including the fabric type and the thread type (S12).

Then, an initial value '1' is assigned to an embroidery pattern counter N (S13). In step S14, data of an embroidery pattern region corresponding to the counter N is read from the embroidery data which is selected in advance. In step S15, an analyzing process for analyzing the embroidery region in regard to a stitch form is executed. In the analyzing process, embroidery patterns in the embroidery data are categorized by the satin stitch, the tatami stitch and the running stitch. In other words, the analyzing process is executed for determining which of the satin stitch, the tatami stitch and the running stitch the embroidery data contains.

First, variables Pi (i=1, 2, . . . , n) are assigned to needle drop points (the total number of needle drop points is n) contained in the embroidery data, respectively. An initial value 1 is assigned to the variable i. An orthogonal coordinate system is set for each of the needle drop points (i.e., each orthogonal coordinate system has an origin point Pi).

Figure 12A:
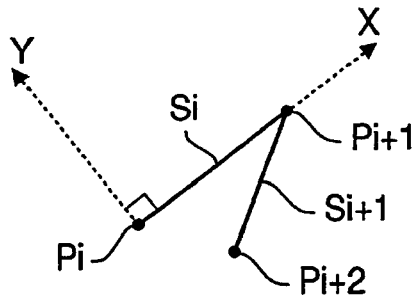
FIG. 12A illustrates an example of a stitch pattern having turning back of stitches.
Figure 12B:
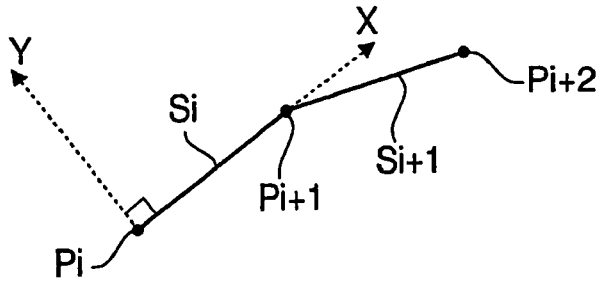
FIG. 12B illustrates an example of a stitch pattern not having turning back of stitches.

As shown in FIGS. 12A and 12B, the x-axis is set along a line extending from a needle drop point (the origin point) Pi to a needle drop point $P_{i+1}$, and y-axis is set along a line obtained by rotating counterclockwise the x-axis by 90°. Then, a coordinate ($X_{i+1}$, 0) of the needle drop point $P_{i+1}$ and the coordinate ($X_{i+2}$, $Y_{i+2}$) of the needle drop point $P_{i+2}$ are read out from the embroidery data, and are stored in a coordinate memory area in the RAM 23.

Next, the values of $X_{i+1}$ and $X_{i+2}$ are compared with each other. If $X_{i+1}$ is greater than $X_{i+2}$, the attribute of the needle drop point $P_{i+1}$ is defined as a tentative contour point. If $X_{i+2}$ is greater than or equal to $X_{i+1}$ ($X_{i+2} \geqq X_{i+1}$), the attribute of the needle drop point $P_{i+1}$ is defined as a tentative running stitch point. If the needle drop point $P_{i+1}$ is a contour point as shown in FIG. 12A, turning back is caused in regard to the stitches $S_i$ and $S_{i+1}$. In this case, $X_{i+2}$ is smaller than $X_{i+1}$ ($X_{i+2} < X_{i+1}$). In this case, the attribute of the needle drop point $P_{i+1}$ can be assumed to be a contour point, and therefore the needle drop point $P_{i+1}$ is defined as a tentative contour point.

If the needle drop point $P_{i+1}$ is a running stitch point, $X_{i+2}$ is greater than or equal to $X_{i+1}$ ($X_{i+2} \geqq X_{i+1}$) as shown in FIG. 12B. In this case, the needle drop point $P_{i+1}$ can be assumed to be a running stitch point and therefore the attribute of the needle drop point $P_{i+1}$ is defined as a tentative running stitch point. Attributes of tentative running stitch points are assigned to needle drop points $P_1$ and Pn.

The above mentioned process is executed repeatedly while the variable i is incremented. In the state where (i+1) reaches n, all of the needle drop points (i+1=2 to n−1) have been assigned attributes of tentative contour points or tentative running stitch points.

Next, the stitch forms are categorized as follows. First, the control unit 10 judges whether a needle drop point $P_{i+1}$ is assigned the attribute of the tentative contour point while assigning 1, 2, 3 . . . to the variable i. If $P_{i+1}$ is a tentative running stitch point, the control unit 10 assigns a next greater value to the variable i and repeats the above judgment. If $P_{i+1}$ is the tentative contour point, the control unit 10 judges whether the needle drop point $P_{i+1}$ adjoins to a needle drop point having the attribute of the tentative running stitch point (i.e., judges whether one of the needle drop points $P_i$ and $P_{i+2}$ is the tentative running stitch point). If the point $P_{i+1}$ adjoins to a point having the attribute of the tentative running stitch point, $Y_{i+2}$, which has been saved in the process in which the tentative contour point attribute is assigned to the needle drop point $P_{i+1}$, is read out.

If signs of $Y_{i+2}$ obtained in a like manner for the needle drop points of the tentative contour point located on the front or rear side of the point $P_i$ are different from each other, a tentative tatami contour is assigned to the stitch attribute of the needle drop point $P_{i+1}$. If signs of $Y_{i+2}$ obtained in a like manner for the needle drop points of the tentative contour point located on the front or rear side of the point $P_i$ are equal to each other, a tentative running stitch is assigned to the stitch attribute of the needle drop point $P_{i+1}$.

If the needle drop point $P_i$ does not adjoin to a needle drop point of the tentative running stitch point and signs of $Y_{i+2}$ between the front and rear tentative contour points are replaced with each other, the needle drop point $P_{i+1}$ is assigned a tentative satin contour. On the other hand, signs of $Y_{i+2}$ between the front and rear tentative contour points are not replaced with each other, an attribute of a tentative running stitch point is assigned to the needle drop point $P_{i+1}$.

Finally, shapes, thread densities, tatami patterns, and etc. of needle drop points located at the front and rear sides of each of the needle drop points assigned the attribute of the tentative tatami contour are obtained, and a process for fixing a contour of an embroidery region of the tatami stitch is executed using the obtained data. Shapes, thread densities, and etc. of needle drop points located at the front and rear sides of each of the needle drop points assigned the attribute of the tentative satin contour are obtained, and a process for fixing a contour of an embroidery region of the satin stitch is executed using the obtained data. Then, a process for fixing the needle drop points, which are not defined as the tentative tatami contour attribute and the tentative satin contour attribute, as an embroidery region of the running stitch is executed.

Referring back to FIG. 7, after the analyzing process is finished, the thread density and the size of the embroidery region are calculated based on the result of analyzing (S 16). Specifically, the thread density is obtained as the number of stitches per 1 mm based on the coordinates of the needle drop points, and the size of the embroidery region is obtained using the coordinates of needle drop points within the embroidery region.

Next, the control unit 10 judges whether embroidery data of the embroidery region is formed by the satin stitch. If the result of the analyzing step indicates that embroidery data of the embroidery region is formed by the satin stitch (S17: YES), a correction value A obtained from the correction ratio table T2 is determined by multiplying a correction ratio a (3%) by a stitch pitch P (S30). If the result of S17 is NO, control proceeds to step S18 where the control unit 10 judges whether embroidery data of the embroidery region is formed by the tatami stitch. If the result of the analyzing step indicates that embroidery data of the embroidery region is formed by the tatami stitch (S18: YES), a correction value A obtained from the correction ratio table T2 is determined by multiplying a correction ratio b (1%) by a stitch lengthwise size L (S31).

The stitch pitch P means the length of a stitch, and the stitch lengthwise size L means the length from a contour point to a next contour point. If the judgment result of S18 is NO, or S30 or S31 is finished, control proceeds to step S19 where the thread density is obtained and the correction value Ha corresponding to the thread density is obtained from the correction value table T1 and the correction value A is updated, by adding the correction value Ha to the correction value A. Next, in step S20, an area of the embroidery region is obtained based on the result of the analyzing, the correction value Hb corresponding to the area is obtained from the correction value table T1, and then the correction value A is updated by adding the correction value Hb to the correction value A.

Next, the correction value Hc corresponding to the fabric type designated in S12 is read out from the correction value table T1, and the correction value A is updated by adding the correction value Hc to the correction value A (S21). Next, the correction value Hd corresponding to the embroidery frame type designated in S12 is read out from the correction value table Ti, and the correction value A is updated by adding the correction value Hd to the correction value A (S22).

Next, the correction value He corresponding to the fabric type designated in S12 is read out from the correction value table T1, and the correction value A is updated by adding the correction value He to the correction value A (S23). Next, a positional relationship between an embroidery region and a print region is judged based on the embroidery condition set in step S12 (S24). If the embroidery region is to be overlapped on the print region (S24: overlap), control proceeds to step S25 where a data correction process for a positional relationship of overlap (FIG. 8) is executed.

Figure 8:
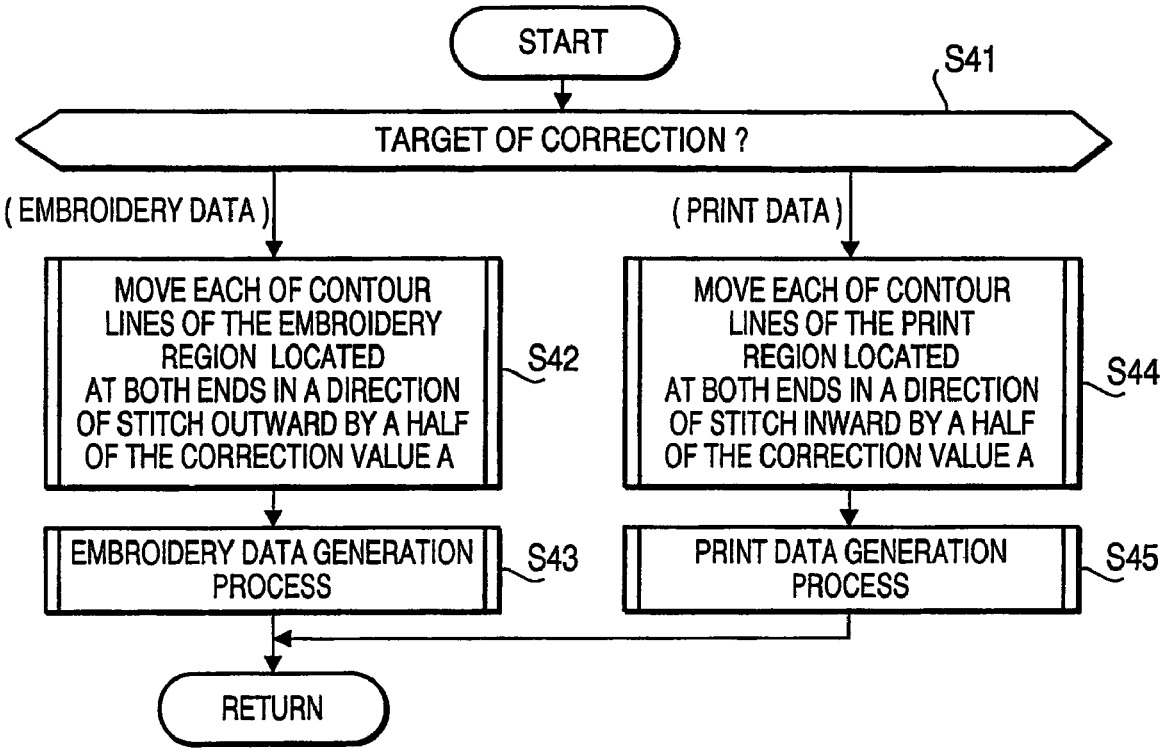
FIG. 8 is a flowchart illustrating a data correction process for a positional relationship of overlap.

FIG. 8 is a flowchart illustrating the data correction process for a positional relationship of overlap. As shown in FIG. 8, in step S41, the control unit 10 makes a decision on a target of correction based on the embroidery condition set in step S12 (S41). If the target of correction is embroidery data (S41: embroidery data), control proceeds to step S42. In step S42, each of contour lines of the embroidery region located at both ends in a direction of stitch (and/or a direction orthogonal to the direction of stitch) is moved outward by a half of the correction value A. Next, embroidery data corresponding to the embroidery region corrected as mentioned above is generated (S43). Then, the data correction process for a positional relationship of overlap terminates.

If it is judged in step S41 that the target of correction is print data (S41: print data), control proceeds to step S44. In step S44, each of contour lines of the print region located at both ends in a direction of stitch (and/or a direction orthogonal to the direction of stitch) are moved inward by a half of the correction value A. Next, print data corresponding to the print region corrected as mentioned above is generated (S45). Then, the data correction process for a positional relationship of overlap terminates.

Referring back to FIG. 7, if it is judged in step S24 that the embroidery region is to be surrounded by the print region (S24: surrounding), control proceeds to step S26 where a data correction process for a positional relationship of surrounding (FIG. 9) is executed.

Figure 9:
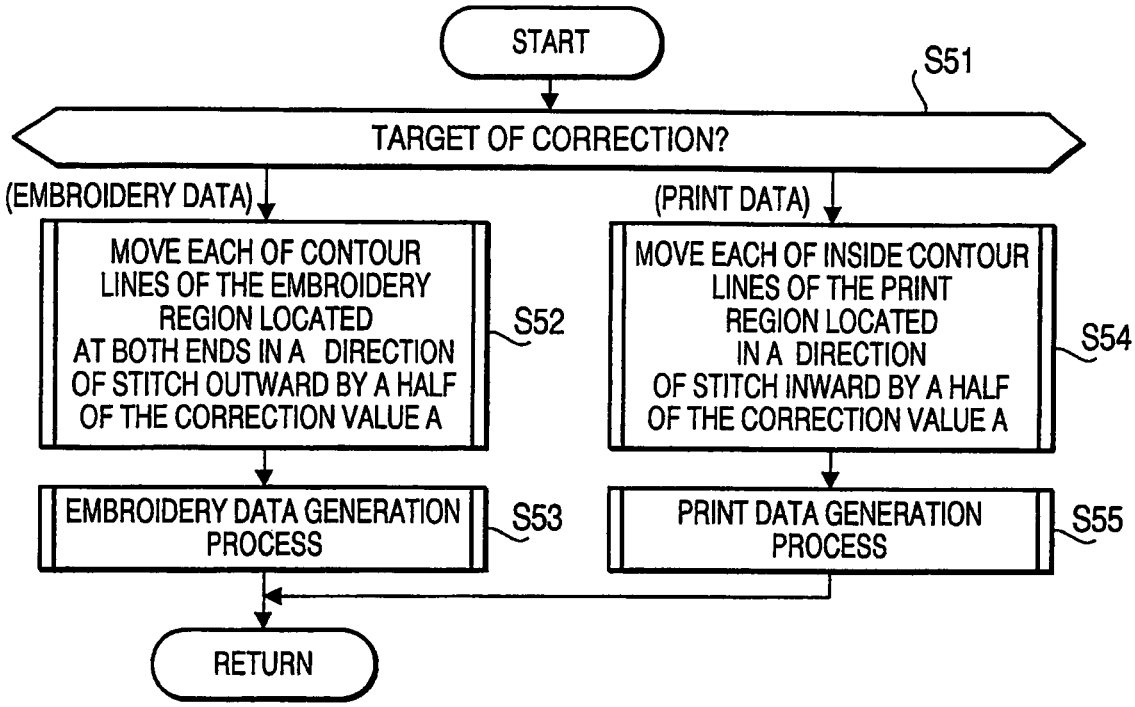
FIG. 9 is a flowchart illustrating a data correction process for a positional relationship of surrounding.

FIG. 9 is a flowchart illustrating the data correction process for a positional relationship of surrounding. As shown in FIG. 9, in step S51, the control unit 10 makes a decision on a target of correction (S51). If the target of correction is embroidery data (S51: embroidery data), control proceeds to step S52. In step S52, each of contour lines of the embroidery region located at both ends in a direction of stitch (and/or a direction orthogonal to the direction of stitch) is moved outward by a half of the correction value A. Next, embroidery data corresponding to the embroidery region corrected as mentioned above is generated (S53). Then, the data correction process for a positional relationship of surrounding terminates.

If it is judged in step S51 that the target of correction is print data (S51: print data), control proceeds to step S54. In step S54, each of inside contour lines of the print region located in a direction of stitch (and/or a direction orthogonal to the direction of stitch) are moved inward by a half of the correction value A. Next, print data corresponding to the print region corrected as mentioned above is generated (S55). Then, the data correction process for a positional relationship of surrounding terminates.

Referring back to FIG. 7, if it is judged in step S24 that the embroidery region is to be located in parallel with the print region (S24: parallel), control proceeds to step S27 where a data correction process for a parallel positional relationship (FIG. 10) is executed.

Figure 10:
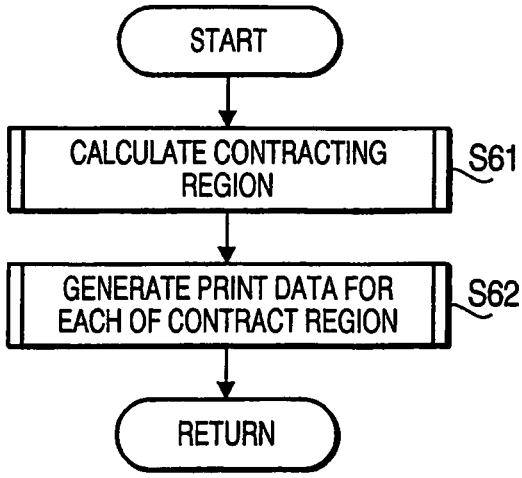
FIG. 10 is a flowchart illustrating a data correction process for a parallel positional relationship.

FIG. 10 is a flowchart illustrating the data correction process for a parallel positional relationship. As shown in FIG. 10, a contracting region obtaining process is executed (S61). In the contracting region obtaining process, a contracting region having the width of a half of the correction value in a direction of stitch is calculated at a position inside of each of contour lines of the print region located at both ends in a direction of stitch (and/or a direction orthogonal to the direction of stitch) because the contour lines are expected to move inward by a half of the correction value A.

Next, print data is generated for each contract region (S62). Then, the data correction process for a parallel positional relationship terminates. In step S62, color data for print images in a color corresponding to a thread color of the embroidery region is added to the print data.

Referring back to FIG. 7, in step S28, the control unit 10 judges whether the embroidery pattern represented by the counter N is the last. If the embroidery pattern represented by the counter N is not the last (S28: NO), control proceeds to step S29 where the counter N is incremented by 1. Then, control returns to step S14. If the embroidery pattern represented by the counter N is the last (S28: YES), the data processing main routine terminates.

Hereafter, examples of operations and effects attained by the data processing device 1 will be explained. If an operator selects an item "data generation" from a main menu displayed on the display 14, print data is generated based on image data of a design Z of a timber (see FIG. 11) read by the image scanner 13, and embroidery data is also generated.

If the operator selects an item "data processing" from the main menu displayed on the display 14, the embroidery condition setting menu screen is displayed on the display 14. For example, the operator may designate "YES" for an item "execution of correction", "knit fabric" for an item "fabric type", "nylon" for an item "thread type", "large" for "embroidery frame type", "embroidery data" for an item "target of correction" and "overlap" for an item "positional relationship of regions" through the embroidery condition setting menu screen.

In this case, a region of the satin stitch is obtained by the above mentioned analyzing process, and then an area and a thread density of the embroidery region are obtained. Next, a correction value A for satin stitch is obtained by calculation performed based on a correction ratio a and a stitch pitch P. Then, the correction value A is updated reflecting a correction value Ha (0.1 mm) for a thread density greater than or equal to 40 (lines/mm), a correction value Hb (0 mm) for an area of the embroidery region smaller than or equal to 5000 $mm^2$, a correction value of Hc (0.1 mm) for the fabric type, a correction value Hd (0.1 mm) for the embroidery frame type, and a correction value He (0.1 mm) for the thread type (i.e., the total correction value A is obtained by adding the correction values Ha, Hb, Hc, Hd, and He to the basic correction value A).

If the embroidery region and the print region are in a positional relationship of overlap, and the target of correction is the embroidery region, each of contour lines of the embroidery region located at both ends in a direction of stitch (and/or a direction orthogonal to the direction of stitch) is moved outward by a half of the correction value A as shown in FIG. 14 (see a double chain line in FIG. 14). Next, embroidery data corresponding to the embroidery region corrected as indicated by a double chain line in FIG. 14 is generated.

Figure 15:
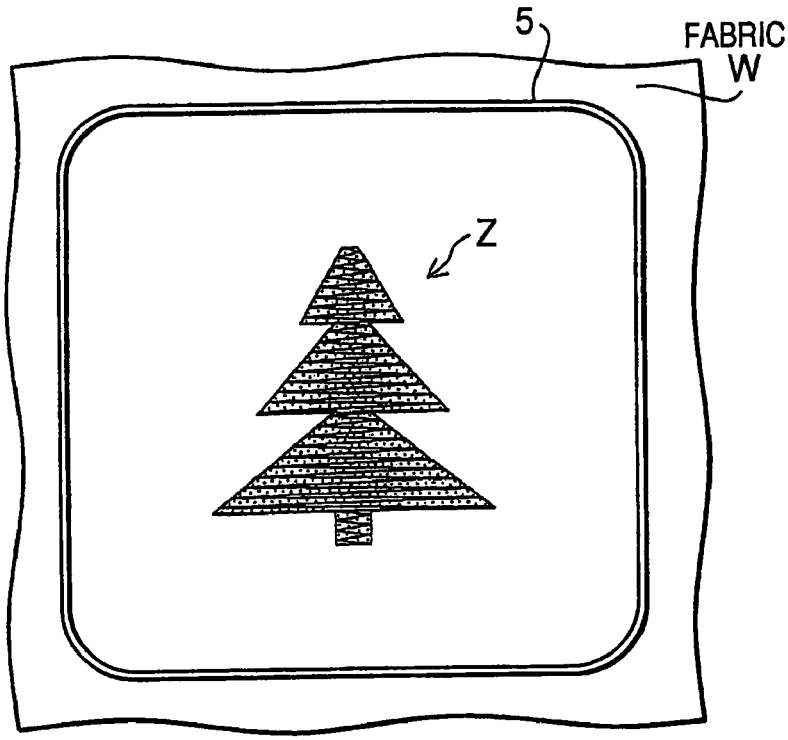
FIG. 15 illustrates an example of a situation in which embroidering and printing are performed on fabric held on an embroidery frame.

In this case, the embroidery region is divided into blocks according to the shape thereof, and needle drop points are obtained for each of the blocks. If an embroidery pattern corresponding to the embroidery region as corrected (expanded) above is embroidered on fabric W, the size of the embroidery pattern of the design Z of the timber becomes equal to the original size of the embroidery region as shown in FIG. 15 even of the fabric W shrinks due to embroidery.

If the printing operation is performed on the fabric W on which the embroider pattern corresponding to the corrected (expanded) embroider region has been already formed, an outer shape of the print region coincides with the outer shape of the embroidery region. Therefore, fabric having an aesthetic timber design formed as a combination of a timber of an embroidery pattern and a timber of a printed image can be attained. In FIG. 5, the satin stitch is represented by a zigzag pattern, and the printed image is represented by a dotted pattern.

Meanwhile, if the target of correction is a print region, each of contour lines of the print region located at both ends in a direction of stitch (and/or a direction orthogonal to the direction of stitch) are moved inward by a half of the correction value A. Next, print data corresponding to the print region corrected as mentioned above is generated.

As described above, even if the fabric shrinks due to embroidery when the print region and the embroidery region are overlapped with each other on the fabric, the outer shape of the embroidery pattern and the outer shape of the printed image coincide with each other because one of the embroider region and the print region is corrected. Consequently, an embroidery timber pattern and a printed timber image are combined (overlapped) together as an aesthetic design.

Figure 16:
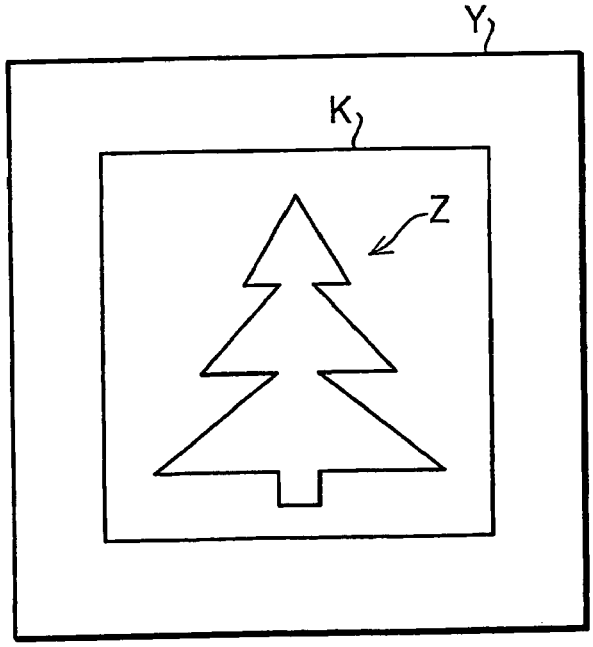
FIG. 16 illustrates a sheet on which a timber pattern and a rectangular pattern are drawn.
Figures 17, 18:
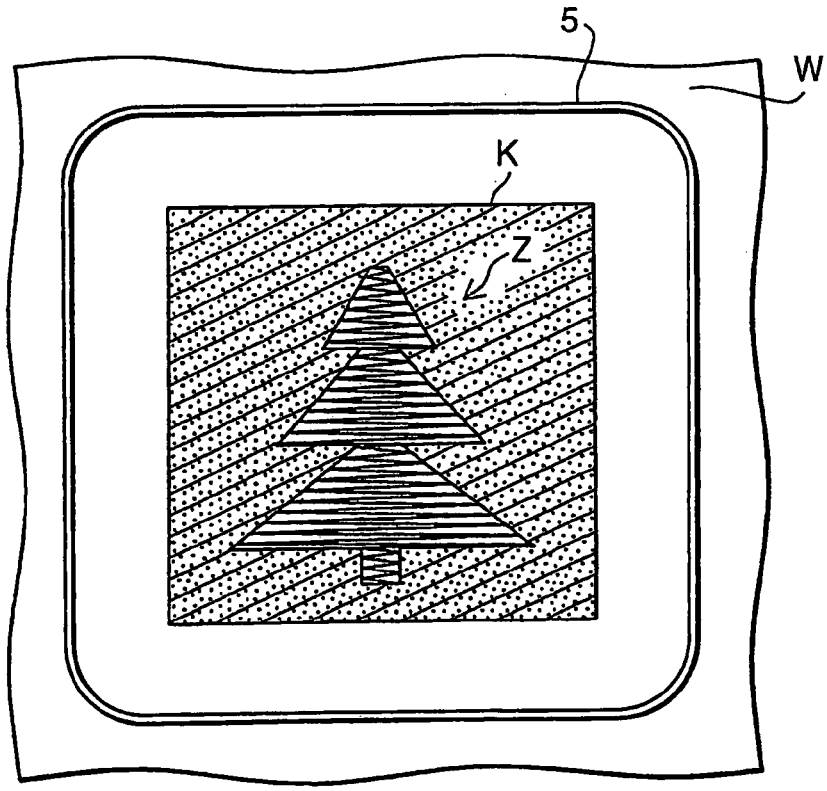
FIG. 17 shows an example of an embroidery condition displayed on a setting menu screen.
FIG. 18 illustrates another example of a situation in which embroidering and printing are performed on fabric held on an embroidery frame.

If an image including a timber design Z and a rectangular frame design K formed on a sheet Y shown in FIG. 16 is read by the image scanner 13, and embroidery data of the timber design Z and print data of the rectangular frame design K (in which the shape of the timber Z is clipped) are to be formed, the following operation is performed. In this case, the embroidery condition settings are designated by the operator as shown in FIG. 17. As shown in FIG. 17, the operator designates "surrounding" for an item of the positional relationship for regions.

In this case, the embroidery data is subjected to the analyzing process as described above, and the correction value A reflecting the correction values Ha, Hb, Hc, Hd and He is obtained by calculation (i.e., the total correction value A is obtained by adding the correction values Ha, Hb, Hc, Hd, and He to a basic correction value A). Specifically, each of contour lines of the embroidery region located at both ends in a direction of stitch (and/or a direction orthogonal to the direction of stitch) is moved outward by a half of the correction value A. Then, the embroidery data for the embroidery region enlarged in the direction of stitch (indicated by the double chain line in FIG. 14) is generated.

If the embroidery operation is performed on the fabric W (held on the embroidery frame 5) using the thus enlarged embroidery data, the timber design Z is embroidered on the fabric in an original size as shown in FIG. 18 even if the fabric W shrinks due to the embroidery, because the embroidery region is enlarged in the direction of stitch in accordance with the shrinking amount of the fabric due to the embroidery. Next, the frame design K is printed on the fabric such that the inner contour line of the print region and the outer contour line of the embroidery region are coincide with each other. Consequently, it is possible to reliably insert the embroidery pattern into the inside of the printed image. In FIG. 18, the satin stitch is represented by a zigzag pattern, and the printed image is represented by a hatching patter.

Meanwhile, if the target of correction is the print region, each of contour lines of the print region located at both ends in a direction of stitch (and/or a direction orthogonal to the direction of stitch) is moved inward by a half of the correction value A. Next, print data corresponding to the print region corrected as mentioned above is generated.

As described above, if the embroidering and printing operations are performed such that the embroidery region is surrounded by the print region, one of the embroidery region and the print region is corrected so that the outer contour (outer shape) of the embroidery region coincided with the inner contour (inner shape) of the print region. Therefore, the occurrence of space is prevented from being produced at the boundary between the outer shape of the embroider region and the inner shape of the print region. Therefore, fabric on which texture, stereoscopic effect and the sense of gorgeous are suitably represented can be produced.

Figures 19, 20:
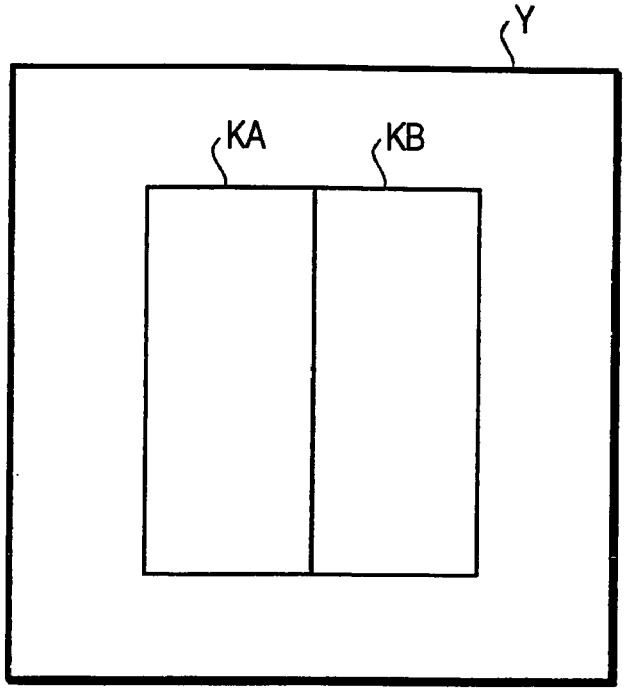
FIG. 19 illustrates a sheet on which two rectangular shapes are drawn.
FIG. 20 shows an example of an embroidery condition displayed on a setting menu screen.

If an image including a pair of rectangular patterns KA and KB formed on a sheet Y shown in FIG. 19 is read by the image scanner 13, and embroidery data of the rectangular pattern KA and the rectangular pattern KB are to be formed, the following operation is performed. It should be noted that the rectangular pattern KA is arranged in parallel with the rectangular pattern KB. In this case, the embroidery condition settings are designated by the operator as shown in FIG. 20. As shown in FIG. 20, the operator designates "parallel" for an item of the positional relationship for regions.

In this case, the embroidery data is subjected to the analyzing process as described above, and the correction value A reflecting the correction values Ha, Hb, Hc, Hd and He is obtained by calculation (i.e., the total correction value A is obtained by adding the correction values Ha, Hb, Hc, Hd, and He to a basic correction value A). Specifically, contracting regions Pa, Pb, Pc and Pd each having the width of a half of the correction value A in a direction of stitch are defined at positions inside of contour lines of the embroidery region in a direction of stitch because each the contour lines are expected to move inward by a half of the correction value A.

Figure 21:
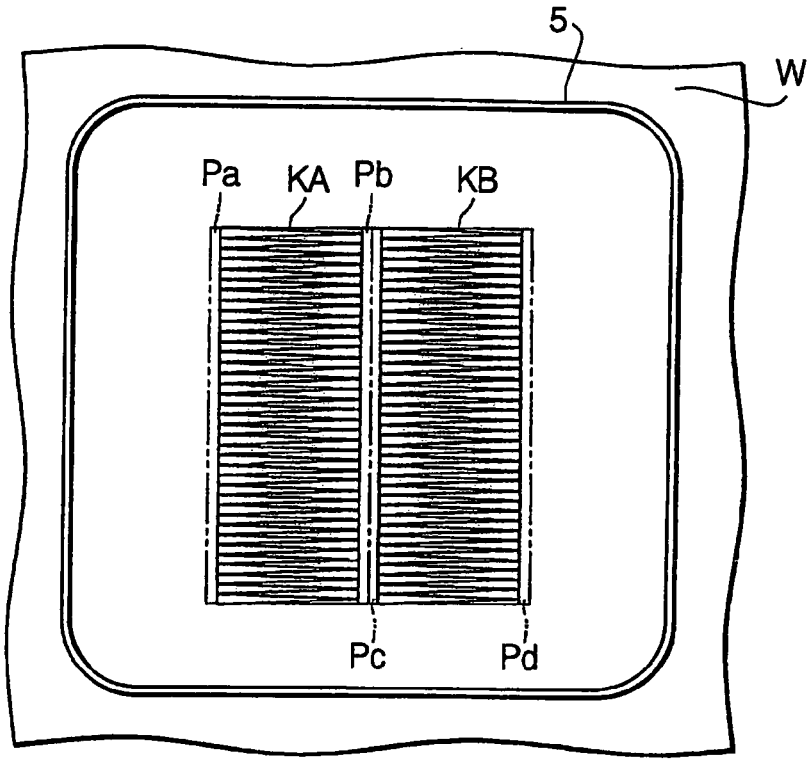
FIG. 21 illustrates an example of a situation in which embroidering is performed on fabric held on an embroidery frame.
Figure 22:
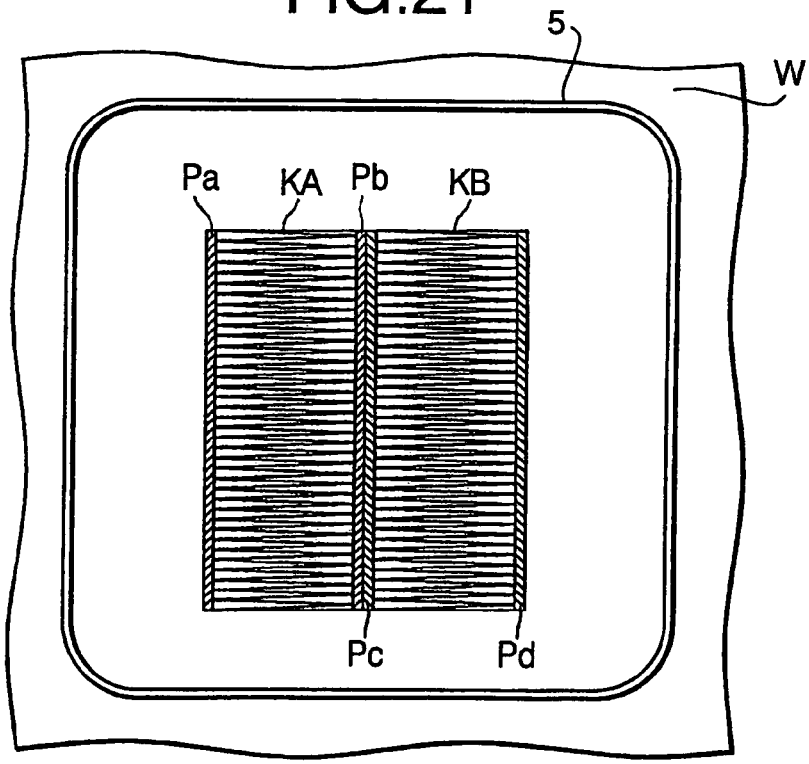
FIG. 22 illustrates an example of a situation in which printing is performed on fabric held on an embroidery frame.

If the embroidering operation is performed on the fabric W held on the embroidery frame 5) based on not corrected embroidery data, each of the contour lines of the rectangular pattern KA (KB) in the direction of stitch shrinks inward by a half of the correction value A as shown in FIG. 21.

By contrast, according to the embodiment, the contracting regions Pa and Pb are subjected to the printing operation in a color corresponding to the thread color of the embroidery region KA, and the contracting regions Pc and Pd are subjected to the printing operation in a color corresponding to the thread color of the embroidery region KB. Since the contracting regions are filled by appropriate colors by the printing operation (i.e., the contracting regions due to embroidery are complemented by printing), texture, stereoscopic effect and the sense of gorgeous can be suitably represented on fabric.

Although the present disclosure has been described in considerable detail with reference to certain preferred embodiments thereof, other embodiments are possible.

Values different from those shown in the above mentioned embodiment may be adopted as the correction values for Ha, Hb, Hc, Hd and He. The correction values Ha, Hb, Hc, Hd and He (i.e., the values of Table T1 shown in FIG. 4) may be settable by an operator.

Values different from those shown in the above mentioned embodiment may be adopted as the correction ratios a and b. The correction ratios a and b (i.e., the values of Table T2 shown in FIG. 5) may be settable by an operator.

If embroidery data includes an embroidery region having a form of a circle or a curved line, the embroidery region may be corrected such that an moving amount of each outer contour line increases as the stitch pitch P increases.

In the above mentioned, the data processing device 1 and the embroidery machine 2 are provided as separate devices. However, the control unit 42 may have the function of the data processing device 1. In this case, it is not necessary to provided the personal computer functioning as the data processing device 1 for the system 100.

What is claimed is:

1. A data processing device, comprising:

a data providing unit that provides print data and embroidery data to be subjected to printing and embroidering, respectively, a print region of the print data and an embroidery region of the embroidery data having a predetermined positional relationship; and a data correction unit that corrects at least one of the embroidery data and the print data so that the predetermined positional relationship between the embroidery region defined in the embroidery data and the print region defined in the print data is maintained on fabric after the embroidering in accordance with the embroidery data and the printing in accordance with the print data are performed on the fabric, considering shrinkage of the fabric caused by the embroidering in accordance with the embroidery data;

wherein the data correction unit is configured to determine a form of stitches of an embroidery pattern defined in the embroidery data, and to correct the print data so as to shrink a size of the print region in a predetermined direction if the determined form of stitches corresponds to a predetermined stitch form.

2. The data processing device according to claim 1, wherein:

the predetermined positional relationship between the embroidery region and the print region is such that the embroidery region overlaps with the print region; and the data correction unit corrects at least one of the embroidery data and the print data so that an outer shape of the embroidery region and an outer shape of the print region are kept from shifting with respect to each other on the fabric even if shrinkage of the fabric is caused by the embroidering in accordance with the embroidery data.

3. The data processing device according to claim 1, wherein:

the predetermined positional relationship between the embroidery region and the print region is such that the embroidery region is surrounded by the print region; and the data correction unit corrects at least one of the embroidery data and the print data so that an outer shape of the embroidery region and an inner shape of the print region are kept from shifting with respect to each other on the fabric even if shrinkage of the fabric is caused by the embroidering in accordance with the embroidery data.

4. The data processing device according to claim 1, wherein the data providing unit is configured to obtain the embroidery data from an external device and to generate the print data based on the obtained embroidery data.

5. The data processing device according to claim 1, wherein the data providing unit is configured to obtain image data from an external device and to generate the embroidery data and the print data based on the obtained data.

6. The data processing device according to claim 1, wherein the data correction unit is configured to determine a direction of stitches of an embroidery pattern defined in the embroidery data, and to correct the print data so as to shrink the size of the print region in the determined direction of stitches.

7. The data processing device according to claim 1, wherein the data correction unit is configured to determine a thread density of an embroidery pattern defined in the embroidery data, and to correct the print data according to the determined thread density.

8. The data processing device according to claim 1, wherein the data correction unit is configured to determine an area of the embroidery region based on the embroidery data, and to correct the print data according to the determined area of the embroidery region.

9. The data processing device according to claim 1, further comprising a setting unit that allows an operator to designate a fabric type;

wherein the data correction unit corrects the print data according to the fabric type designated by the operator through the setting unit.

10. The data processing device according to claim 1, further comprising a setting unit that allows an operator to designate a thread type;

wherein the data correction unit corrects the print data according to the thread type designated by the operator through the setting unit.

11. The data processing device according to claim 1, further comprising a setting unit that allows an operator to designate a type of an embroidery frame used for holding fabric in the embroidering;

wherein the data correction unit corrects the print data according to the type of the embroidery frame designated by the operator through the setting unit.

12. The data processing device, according to claim 1, further comprising:

a contracting region obtaining unit that obtains a contracting region generated as a difference between a shape of an embroidery region defined in the embroidery data and a shape of the embroidery region formed on fabric when shrinkage of the fabric is caused by the embroidering operation in accordance with the embroidery data; and a print data generation unit that generates print data used for a printing operation for the contracting region.

13. The data processing device according to claim 1, wherein the data providing unit is configured to obtain image data from an external device and to generate the embroidery data based on the obtained image data.

14. A computer-readable storage medium that stores a computer-executable program for controlling embroidering and printing, the program comprising;

instructions for providing print data and embroidery data to be subjected to printing and embroidering, respectively, a print region of the print data and an embroidery region of the embroidery data having a predetermined positional relationship;

instructions for determining a form of stitches of an embroidery pattern defined in the embroidery data; and instructions for correcting at least one of the embroidery data and the print data so that the predetermined positional relationship between the embroidery region and the print region is maintained on fabric after the embroidering in accordance with the embroidery data and the printing in accordance with the print data are performed on the fabric, considering shrinkage of the fabric caused by the embroidering in accordance with the embroidery data;

wherein if the determined form of stitches corresponds to a predetermined form, the print data is corrected so as to shrink a size of the print region in a predetermined direction.

15. The computer-readable storage medium according to claim 14, wherein:

the predetermined positional relationship between the embroidery region and the print region is such that the embroidery region overlaps with the print region; and at least one of the embroidery data and the print data is corrected so that an outer shape of the embroidery region and an outer shape of the print region are kept from shifting with respect to each other on the fabric even if shrinkage of the fabric is caused by the embroidering in accordance with the embroidery data.

16. The computer-readable storage medium according to claim 14, wherein:

the predetermined positional relationship between the embroidery region and the print region is such that the embroidery region is surrounded by the print region; and at least one of the embroidery data and the print data is corrected so that an outer shape of the embroidery region and an inner shape of the print region are kept from shifting with respect to each other on the fabric even if shrinkage of the fabric is caused by the embroidering in accordance with the embroidery data.

17. The computer-readable storage medium according to claim 14, the program further comprises:

instructions for obtaining the embroidery data from an external device; and instructions for generating the print data based on the obtained embroidery data.

18. The computer-readable storage medium according to claim 14, the program further comprises:

instructions for obtaining image data from an external device; and instructions for generating the embroidery data and the print data based on the obtained image data.

19. The computer-readable storage medium according to claim 14, the program further comprises:

instructions for determining a direction of stitches of an embroidery pattern defined in the embroidery data;

wherein the print data is corrected so as to shrink the size of the print region in the determined direction of stitches.

20. The computer-readable storage medium according to claim 14, the program further comprises:

instructions for determining a thread density of an embroidery pattern defined in the embroidery data;

wherein the print data is corrected according to the determined thread density.

21. The computer-readable storage medium according to claim 14, the program further comprises:

instructions for determining an area of the embroidery region based on the embroidery data;

wherein the print data is corrected according to the determined area of the embroidery region.

22. The computer-readable storage medium according to claim 14, the program further comprising:

instructions for allowing an operator to designate a fabric type, wherein the print data is corrected according to the fabric type designated by the operator.

23. The computer-readable storage medium according to claim 14, the program further comprising:

instructions for allowing an operator to designate a thread type, wherein the print data is corrected according to the thread type designated by the operator.

24. The computer-readable medium according to claim 14, the program further comprising:

instructions for allowing an operator to designate a type of an embroidery frame used for holding fabric in the embroidering, wherein the print data is corrected according to the type of the embroidery frame designated by the operator.

25. The computer-readable storage medium according to claim 14, the program further comprises:

instructions for obtaining a contracting region generated as a difference between a shape of an embroidery region defined in the embroidery data and a shape of the embroidery region formed on fabric when shrinkage of the fabric is caused by the embroidering in accordance with the embroidery data; and instructions for generating print data used for a printing operation for the contracting region.

26. The computer-readable storage medium according to claim 14, the program further comprises:

instructions for obtaining image data from an external device; and instructions for generating the embroidery data based on the obtained image data.

27. A data processing device, comprising:

a data providing unit that provides print data and embroidery data to be subjected to printing and embroidering, respectively, a print region of the print data and an embroidery region of the embroidery data having a predetermined positional relationship; and a data correction unit that corrects at least one of the embroidery data and the print data so that the predetermined positional relationship between the embroidery region defined in the embroidery data and the print region defined in the print data is maintained on fabric after the embroidering in accordance with the embroidery data and the printing in accordance with the print data are performed on the fabric, considering shrinkage of the fabric caused by the embroidering in accordance with the embroidery data;

wherein the data correction unit is configured to determine a form of stitches of an embroidery pattern defined in the embroidery data, and to correct the embroidery data to enlarge a size of the embroidery region in a predetermined direction if the determined form of stitches corresponds to a predetermined stitch form.

28. The data processing device according to claim 27, wherein:

the predetermined positional relationship between the embroidery region and the print region is such that the embroidery region overlaps with the print region; and the data correction unit corrects at least one of the embroidery data and the print data so that an outer shape of the embroidery region and an outer shape of the print region are kept from shifting with respect to each other on the fabric even if shrinkage of the fabric is caused by the embroidering in accordance with the embroidery data.

29. The data processing device according to claim 27, wherein:

the predetermined positional relationship between the embroidery region and the print region is such that the embroidery region is surrounded by the print region; and the data correction unit corrects at least one of the embroidery data and the print data so that an outer shape of the embroidery region and an inner shape of the print region are kept from shifting with respect to each other on the fabric even if shrinkage of the fabric is caused by the embroidering in accordance with the embroidery data.

30. The data processing device according to claim 27, wherein the data providing unit is configured to obtain the embroidery data from an external device and to generate the print data based on the obtained embroidery data.

31. The data processing device according to claim 27, wherein the data providing unit is configured to obtain image data from an external device and to generate the embroidery data and the print data based on the obtained data.

32. The data processing device according to claim 27, wherein the data correction unit is configured to determine a direction of stitches of an embroidery pattern defined in the embroidery data, and to correct the embroidery data so as to enlarge the size of the embroidery region in the determined direction of stitches.

33. The data processing device according to claim 27, wherein the data correction unit is configured to determine a thread density of an embroidery pattern defined in the embroidery data, and to correct the embroidery data according to the determined thread density.

34. The data processing device according to claim 27, wherein the data correction unit is configured to determine an area of the embroidery region based on the embroidery data, and to correct the embroidery data according to the determined area of the embroidery region.

35. The data processing device according to claim 27, further comprising a setting unit that allows an operator to designate a fabric type;

wherein the data correction unit corrects the embroidery data according to the fabric type designated by the operator through the setting unit.

36. The data processing device according to claim 27, further comprising a setting unit that allows an operator to designate a thread type;

wherein the data correction unit corrects the embroidery data according to the thread type designated by the operator through the setting unit.

37. The data processing device according to claim 27, further comprising a setting unit that allows an operator to designate a type of an embroidery frame used for holding fabric in the embroidering;

wherein the data correction unit corrects the embroidery data according to the type of the embroidery frame designated by the operator through the setting unit.

38. The data processing device according to claim 27, further comprising:

a contracting region obtaining unit that obtains a contracting region generated as a difference between a shape of an embroidery region defined in the embroidery data and a shape of the embroidery region formed on fabric when shrinkage of the fabric is caused by the embroidering operation in accordance with the embroidery data; and a print data generation unit that generates print data used for a printing operation for the contracting region.

39. The data processing device according to claim 27, wherein the data providing unit is configured to obtain image data from an external device and to generate the embroidery data based on the obtained image data.

40. A data processing device, comprising:

a data providing unit that provides print data and embroidery data to be subjected to printing and embroidering, respectively, a print region of the print data and an embroidery region of the embroidery data having a predetermined positional relationship; and a data correction unit that corrects at least one of the embroidery data and the print data so that the predetermined positional relationship between the embroidery region defined in the embroidery data and the print region defined in the print data is maintained on fabric after the embroidering in accordance with the embroidery data and the printing in accordance with the print data are performed on the fabric, considering shrinkage of the fabric caused by the embroidering in accordance with the embroidery data;

wherein the data correction unit is configured to determine a form of stitches of an embroidery pattern defined in the embroidery data, and if the determined form of stitches corresponds to a predetermined stitch form, the data correction unit corrects the print data so as to shrink a size of the print region in a first predetermined direction and corrects the embroidery data so as to enlarge a size of the embroidery region in a second predetermined direction.

41. The data processing device according to claim 40, wherein:

the predetermined positional relationship between the embroidery region and the print region is such that the embroidery region overlaps with the print region; and the data correction unit corrects at least one of the embroidery data and the print data so that an outer shape of the embroidery region and an outer shape of the print region are kept from shifting with respect to each other on the fabric even if shrinkage of the fabric is caused by the embroidering in accordance with the embroidery data.

42. The data processing device according to claim 40, wherein:

the predetermined positional relationship between the embroidery region and the print region is such that the embroidery region is surrounded by the print region; and the data correction unit corrects at least one of the embroidery data and the print data so that an outer shape of the embroidery region and an inner shape of the print region are kept from shifting with respect to each other on the fabric even if shrinkage of the fabric is caused by the embroidering in accordance with the embroidery data.

43. The data processing device according to claim 40, wherein the data providing unit is configured to obtain the embroidery data from an external device and to generate the print data based on the obtained embroidery data.

44. The data processing device according to claim 40, wherein the data providing unit is configured to obtain image data from an external device and to generate the embroidery data and the print data based on the obtained data.

45. The data processing device according to claim 40, further comprising:

a contracting region obtaining unit that obtains a contracting region generated as a difference between a shape of an embroidery region defined in the embroidery data and a shape of the embroidery region formed on fabric when shrinkage of the fabric is caused by the embroidering operation in accordance with the embroidery data; and a print data generation unit that generates print data used for a printing operation for the contracting region.

46. The data processing device according to claim 40, wherein the data providing unit is configured to obtain image data from an external device and to generate the embroidery data based on the obtained image data.

47. A computer-readable storage medium that stores a computer-executable program for controlling embroidering and printing, the program comprising;

instructions for providing print data and embroidery data to be subjected to printing and embroidering, respectively, a print region of the print data and an embroidery region of the embroidery data having a predetermined positional relationship;

instructions for determining a form of stitches of an embroidery pattern defined in the embroidery data; and instructions for correcting at least one of the embroidery data and the print data so that the predetermined positional relationship between the embroidery region and the print region is maintained on fabric after the embroidering in accordance with the embroidery data and the printing in accordance with the print data are performed on the fabric, considering shrinkage of the fabric caused by the embroidering in accordance with the embroidery data;

wherein if the determined form of stitches corresponds to a predetermined stitch form, the embroidery data is corrected so as to enlarge a size of the embroidery region in a predetermined direction.

48. The computer-readable storage medium according to claim 47, wherein:

the predetermined positional relationship between the embroidery region and the print region is such that the embroidery region overlaps with the print region; and at least one of the embroidery data and the print data is corrected so that an outer shape of the embroidery region and an outer shape of the print region are kept from shifting with respect to each other on the fabric even if shrinkage of the fabric is caused by the embroidering in accordance with the embroidery data.

49. The computer-readable storage medium according to claim 47, wherein:

the predetermined positional relationship between the embroidery region and the print region is such that the embroidery region is surrounded by the print region; and at least one of the embroidery data and the print data is corrected so that an outer shape of the embroidery region and an inner shape of the print region are kept from shifting with respect to each other on the fabric even if shrinkage of the fabric is caused by the embroidering in accordance with the embroidery data.

50. The computer-readable storage medium according to claim 47, the program further comprises:

instructions for obtaining the embroidery data from an external device; and instructions for generating the print data based on the obtained embroidery data.

51. The computer-readable storage medium according to claim 47, the program further comprises:

instructions for obtaining image data from an external device; and instructions for generating the embroidery data and the print data based on the obtained image data.

52. The computer-readable storage medium according to claim 47, the program further comprises:

instructions for determining a direction of stitches of an embroidery pattern defined in the embroidery data;

wherein the embroidery data is corrected so as to enlarge the size of the embroidery region in the determined direction of stitches.

53. The computer-readable storage medium according to claim 47, the program further comprises:

instructions for determining a thread density of an embroidery pattern defined in the embroidery data;

wherein the embroidery data is corrected according to the determined thread density.

54. The computer-readable storage medium according to claim 47, the program further comprises:

instructions for determining an area of the embroidery region based on the embroidery data;

wherein the embroidery data is corrected according to the determined area of the embroidery region.

55. The computer-readable storage medium according to claim 47, the program further comprises:

instructions for allowing an operator to designate a fabric type, wherein the embroidery data is corrected according to the fabric type designated by the operator.

56. The computer-readable storage medium according to claim 47, the program further comprises:

instructions for allowing an operator to designate a thread type, wherein the embroidery data is corrected according to the thread type designated by the operator.

57. The computer-readable storage medium according to claim 47, the program further comprises:

instructions for allowing an operator to designate a type of an embroidery frame used for holding fabric in the embroidering, wherein the embroidery data is corrected according to the type of the embroidery frame designated by the operator.

58. The computer-readable storage medium according to claim 47, the program further comprises:

instructions for obtaining a contracting region generated as a difference between a shape of an embroidery region defined in the embroidery data and a shape of the embroidery region formed on fabric when shrinkage of the fabric is caused by the embroidering in accordance with the embroidery data; and instructions for generating print data used for a printing operation for the contracting region.

59. The computer-readable storage medium according to claim 47, the program further comprises:

instructions for obtaining image data from an external device; and instructions for generating the embroidery data based on the obtained image data.

60. A computer-readable storage medium that stores a computer-executable program for controlling embroidering and printing, the program comprising;

instructions for providing print data and embroidery data to be subjected to printing and embroidering, respectively, a print region of the print data and an embroidery region of the embroidery data having a predetermined positional relationship;

instructions for determining a form of stitches of an embroidery pattern defined in the embroidery data; and instructions for correcting at least one of the embroidery data and the print data so that the predetermined positional relationship between the embroidery region and the print region is maintained on fabric after the embroidering in accordance with the embroidery data and the printing in accordance with the print data are performed on the fabric, considering shrinkage of the fabric caused by the embroidering in accordance with the embroidery data, wherein if the determined form of stitches corresponds to a predetermined stitch form, the print data is corrected so as to shrink a size of the print region in a first predetermined direction and the embroidery data is corrected so as to enlarge a size of the embroidery region in a second predetermined direction.

61. The computer-readable storage medium according to claim 60, wherein:

the predetermined positional relationship between the embroidery region and the print region is such that the embroidery region overlaps with the print region; and at least one of the embroidery data and the print data is corrected so that an outer shape of the embroidery region and an outer shape of the print region are kept from shifting with respect to each other on the fabric even if shrinkage of the fabric is caused by the embroidering in accordance with the embroidery data.

62. The computer-readable storage medium according to claim 60, wherein:

the predetermined positional relationship between the embroidery region and the print region is such that the embroidery region is surrounded by the print region; and at least one of the embroidery data and the print data is corrected so that an outer shape of the embroidery region and an inner shape of the print region are kept from shifting with respect to each other on the fabric even if shrinkage of the fabric is caused by the embroidering in accordance with the embroidery data.

63. The computer-readable storage medium according to claim 60, the program further comprises:

instructions for obtaining the embroidery data from an external device; and instructions for generating the print data based on the obtained embroidery data.

64. The computer-readable storage medium according to claim 60, the program further comprises:

instructions for obtaining image data from an external device; and instructions for generating the embroidery data and the print data based on the obtained image data.

65. The computer-readable storage medium according to claim 60, the program further comprises:

instructions for obtaining a contracting region generated as a difference between a shape of an embroidery region defined in the embroidery data and a shape of the embroidery region formed on fabric when shrinkage of the fabric is caused by the embroidering in accordance with the embroidery data; and instructions for generating print data used for a printing operation for the contracting region.

66. The computer-readable storage medium according to claim 60, the program further comprises:

instructions for obtaining image data from an external device; and instructions for generating the embroidery data based on the obtained image data.

* * * * *